US007544011B2

(12) United States Patent
Hall et al.

(10) Patent No.: US 7,544,011 B2
(45) Date of Patent: Jun. 9, 2009

(54) APPARATUS FOR DEPOSITING PAVEMENT REJUVENATION MATERIALS ON A ROAD SURFACE

(76) Inventors: David R. Hall, 2185 S. Larsen Pkwy., Provo, UT (US) 84606; Timothy C. Duke, 2185 S. Larsen Pkwy., Provo, UT (US) 84606; David C. Wahlquist, 2185 S. Larsen Pkwy., Provo, UT (US) 84606

( * ) Notice: Subject to any disclaimer, the term of this patent is extended or adjusted under 35 U.S.C. 154(b) by 557 days.

(21) Appl. No.: 11/164,947

(22) Filed: Dec. 12, 2005

(65) Prior Publication Data

US 2007/0092336 A1 Apr. 26, 2007

Related U.S. Application Data

(63) Continuation-in-part of application No. 11/163,615, filed on Oct. 25, 2005.

(51) Int. Cl.
*E01C 19/21* (2006.01)
*E01C 19/22* (2006.01)
*E01C 19/30* (2006.01)

(52) U.S. Cl. ..... 404/111; 404/101; 404/102; 404/108; 404/113; 404/114; 404/115; 404/116; 404/118

(58) Field of Classification Search ..... 404/101, 404/102, 107–111, 113–116, 118
See application file for complete search history.

(56) References Cited

U.S. PATENT DOCUMENTS 1,807,412 A * 5/1931 Ingalls ..... 404/90
2,042,196 A * 5/1936 Senz ..... 172/777
2,601,277 A * 6/1952 Green ..... 404/92
2,657,092 A * 10/1953 Jones ..... 239/551
3,227,055 A * 1/1966 Glade ..... 404/107
3,284,006 A * 11/1966 Cartwright ..... 239/166
3,361,042 A 1/1968 Cutler
3,732,023 A 5/1973 Rank
3,970,404 A 7/1976 Benedetti
3,989,401 A 11/1976 Moench
4,018,540 A 4/1977 Jackson
4,104,736 A 8/1978 Mendenhall
4,124,325 A 11/1978 Cutler
4,172,679 A 10/1979 Wirtgen
4,195,946 A 4/1980 Swisher
4,335,975 A 6/1982 Schoelkopf
4,347,016 A 8/1982 Sindelar
4,407,605 A 10/1983 Wirtgen (Continued)

*Primary Examiner*—Raymond W Addie
(74) *Attorney, Agent, or Firm*—Daniel P. Nelson; Tyson J. Wilde

(57) ABSTRACT

An apparatus for regulating a flow of pavement rejuvenation materials for deposit on a roadway is disclosed in one aspect of the invention as including a first channel is supported by a pavement recycling machine and is in communication with a supply of pavement rejuvenation materials; a second channel slideably coupled to the first channel, the pavement rejuvenation materials adapted to flow through the first and second channels; and a hardened tip coupled to the second channel. The apparatus may also have a seat coupled to one of the channels; and a blocking element coupled to the other of the channels. Upon sliding the first channel with respect to the second channel, the blocking element contacts the seat, thereby impeding the flow of pavement rejuvenation materials flowing through the channels.

10 Claims, 5 Drawing Sheets

U.S. PATENT DOCUMENTS 4,453,856 A 6/1984 Chiostri
4,473,320 A 9/1984 Register
4,534,674 A 8/1985 Cutler
4,594,022 A 6/1986 Jeppson
4,668,017 A 5/1987 Petersen
4,676,689 A 6/1987 Yant
4,784,518 A 11/1988 Cutler
4,793,730 A 12/1988 Butch
4,968,101 A 11/1990 Bossow
5,109,775 A * 5/1992 Kershaw et al. ..... 104/2
5,366,320 A 11/1994 Hanlon
5,549,457 A * 8/1996 Flores et al. ..... 404/84.05
5,556,225 A 9/1996 Marino
5,765,926 A 6/1998 Knapp
5,791,814 A 8/1998 Wiley
6,158,920 A 12/2000 Malot
6,290,428 B1 * 9/2001 Hall et al. ..... 404/75
6,371,689 B1 4/2002 Wiley
6,623,207 B2 9/2003 Grubba
6,769,836 B2 8/2004 Llyod
6,809,294 B2 * 10/2004 Velinsky et al. ..... 219/213

* cited by examiner

APPARATUS FOR DEPOSITING PAVEMENT REJUVENATION MATERIALS ON A ROAD SURFACE

RELATED APPLICATIONS

This Patent Application is a continuation-in-part of U.S. patent application Ser. No. 11/163,615 filed on Oct. 25, 2005 and entitled Apparatus, System, and Method for In Situ Pavement Recycling, which is herein incorporated by reference in its entirety.

FIELD OF THE INVENTION

The present invention relates to road reconstruction equipment and, more particularly, to apparatus for depositing pavement rejuvenation materials on a roadway.

BACKGROUND

Since their debut in the late 1960s and early 1970s, asphalt milling machines have been considered one of the major innovations in road reconstruction. Asphalt milling machines were originally designed to remove a top layer of deteriorated asphalt so a new layer of asphalt could be overlaid on the exposed underlayer. The resulting pavement was superior to simply overlaying a new layer of asphalt directly onto the old and deteriorated asphalt.

One significant benefit of asphalt milling machines that has emerged modernly is the ability to break up asphalt into recyclable-sized fragments. As recycling of all types has become more popular, asphalt milling machines have similarly increased in popularity. In fact, combination milling and paving machines have been developed to mill or break up the old road surface, mix it with new binder, and lay it down to create a new or recycled road surface in one continuous process.

The core component of most modern asphalt milling machines is the cutting drum. Most cutting drums incorporate numerous cutting teeth, coupled to the rounded surface of the drum, to cut or tear into the road surface. The rotational axis of the drum is positioned parallel to the road surface and the drum is rotated while being driven along the road surface in a direction transverse to its axis of rotation. Conventional cutting drums mill the asphalt in an upward direction, or an "up-cut" direction. However, some cutting drums may permit "down-cutting" to control "slabbing," facilitate pulverizing and mixing, and effectively mill pavement over a wet base. Most cutting drums range in width from 12 to 150 inches and generally have a maximum cutting depth of 4 to 16 inches.

Due to the abrasive nature of pavement, the cutting teeth traditionally wear out quickly and require frequent replacement. The replacement process may create significant downtime and hinder the overall efficiency of the milling process. For example, early cutting drums had cutting teeth that were welded to the drum. Tooth replacement required cutting the old teeth from the drum and welding new teeth in their place. Consequently, considerable effort has been expended to accelerate the replacement process and to increase the durability of the cutting teeth. Many newer cutting teeth, for example, are coupled to the cutting drum using various bolt-on housings to enable faster replacement.

One shortcoming of current asphalt milling machines is their failure to capitalize on cutting-edge technology used in other industries, such as the downhole drilling industry. For example, numerous technological improvements in polycrystalline diamond compact (PDC) bits, which were introduced to the oil and gas industry in the mid 1970s, have enabled PCD bits to capture a growing share of the downhole drill bit market. Some estimates show that between 2000 and 2003, the total footage drilled with PDC bits increased from 26% in 2000 to 50% in 2003. The total revenue generated by PDC bit sales was approximately $600 million in 2003.

Various recent improvements in PDC bit hydraulics, PDC cutter toughness and abrasion-resistance, and PDC bit dynamic stability have resulted in continuous and significant increases in the average rate of penetration (ROP) and bit life of PDC bits, thereby extending the application of PDC bits into harder and more abrasive formations. In some cases, a single PDC bit may drill 20,000 feet or more without replacement. As a result, a PCD bit may save as much as $1 million per well in time-critical drilling applications. It would be a significant advance if drill bit improvements in the downhole drilling industry could be applied to the road reconstruction industry, where downtime and replacement costs incur significant expense.

Accordingly, what are needed are apparatus and methods for incorporating drill bit and other advances of the downhole drilling industry into road reconstruction equipment. More particularly, apparatus and methods are needed to incorporate PCD and other drill bit advances into asphalt milling, grinding, and recycling equipment. Further needed are novel supplemental and auxiliary systems, such as apparatus for depositing new or recycled pavement rejuvenation materials on a roadway, to work in conjunction such apparatus and methods, to facilitate the removal and recycling of asphalt and other pavement materials.

SUMMARY OF THE INVENTION

Consistent with the foregoing, and in accordance with the invention as embodied and broadly described herein, an apparatus for regulating a flow of pavement rejuvenation materials for deposit on a roadway is disclosed in one aspect of the present invention as including a first channel in communication with a supply of pavement rejuvenation materials; a second channel slideably coupled to the first channel, the pavement rejuvenation materials adapted to flow through the first and second channels; and a hardened tip coupled to the second channel. The apparatus may also have a seat coupled to one of the channels; and a blocking element coupled to the other of the channels. Upon sliding the first channel with respect to the second channel, the blocking element contacts the seat, thereby impeding the flow of pavement rejuvenation materials flowing through the channels.

In selected embodiments, the apparatus includes sealing means for sealing the first channel with respect to the second channel, thereby facilitating a flow of pavement rejuvenation materials between the two channels while preventing leakage. An actuator may be used to slide the second channel with respect to the first channel. An actuator may include, for example, a hydraulic, solenoid, mechanical, pneumatic, or other suitable actuator. The actuator may serve to extend and retract the second channel with respect to a roadway.

In selected embodiments, the first channel slides inside the second channel. In such embodiments, a hydraulic piston may be rigidly coupled to the second channel and the first channel may slide through a bore in the hydraulic piston. A housing containing a chamber may be used to accommodate and facilitate the linear movement of the hydraulic piston. In other embodiments, the apparatus includes a vibration mechanism operably coupled to the channels.

In another aspect of the invention, an apparatus for regulating a flow of pavement rejuvenation materials for deposit on a roadway includes a housing; multiple teeth extending from the housing that are independently extendable and retractable with respect to the housing; passageways extending through each of the teeth to accommodate a flow of pavement rejuvenation materials; and valves associated with each of the teeth for controlling the flow of pavement rejuvenation materials passing therethrough.

In certain embodiments, the valves are adapted to close when the teeth associated therewith are in a retracted position and open when the teeth are in an extended position. Each tooth may, in certain embodiments, include a first channel in communication with a supply of pavement rejuvenation materials and a second channel slideably coupled to the first channel. Pavement rejuvenation materials are adapted to flow through the channels. Similarly, the valves may, in certain embodiments, include a seat coupled to one of the channels and a blocking element coupled to the other of the channels. The blocking element contacts the seat upon sliding the first channel with respect to the second channel, thereby impeding the flow of pavement rejuvenation materials flowing through the channels.

The present invention provides novel apparatus for regulating a flow of pavement rejuvenation materials for deposit on a roadway. The features and advantages of the present invention will become more fully apparent from the following description and appended claims, or may be learned by the practice of the invention as set forth hereinafter.

BRIEF DESCRIPTION OF THE DRAWINGS

In order to describe the manner in which the above-recited features and advantages of the present invention are obtained, a more particular description of apparatus and methods in accordance with the invention will be rendered by reference to specific embodiments thereof, which are illustrated in the appended drawings. Understanding that these drawings depict only typical embodiments of the present invention and are not, therefore, to be considered as limiting the scope of the invention, apparatus and methods in accordance with the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment in accordance with the present invention. Thus, use of the phrases "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or the like. Likewise, rejuvenation materials refer to any of various binders, oils, and resins, including bitumen, surfactant, polymeric materials, emulsions, asphalt, tar, cement, oil, pitch, or the like. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, or otherwise taking or pulling apart a pavement material into smaller constituent pieces.

Figure 1:
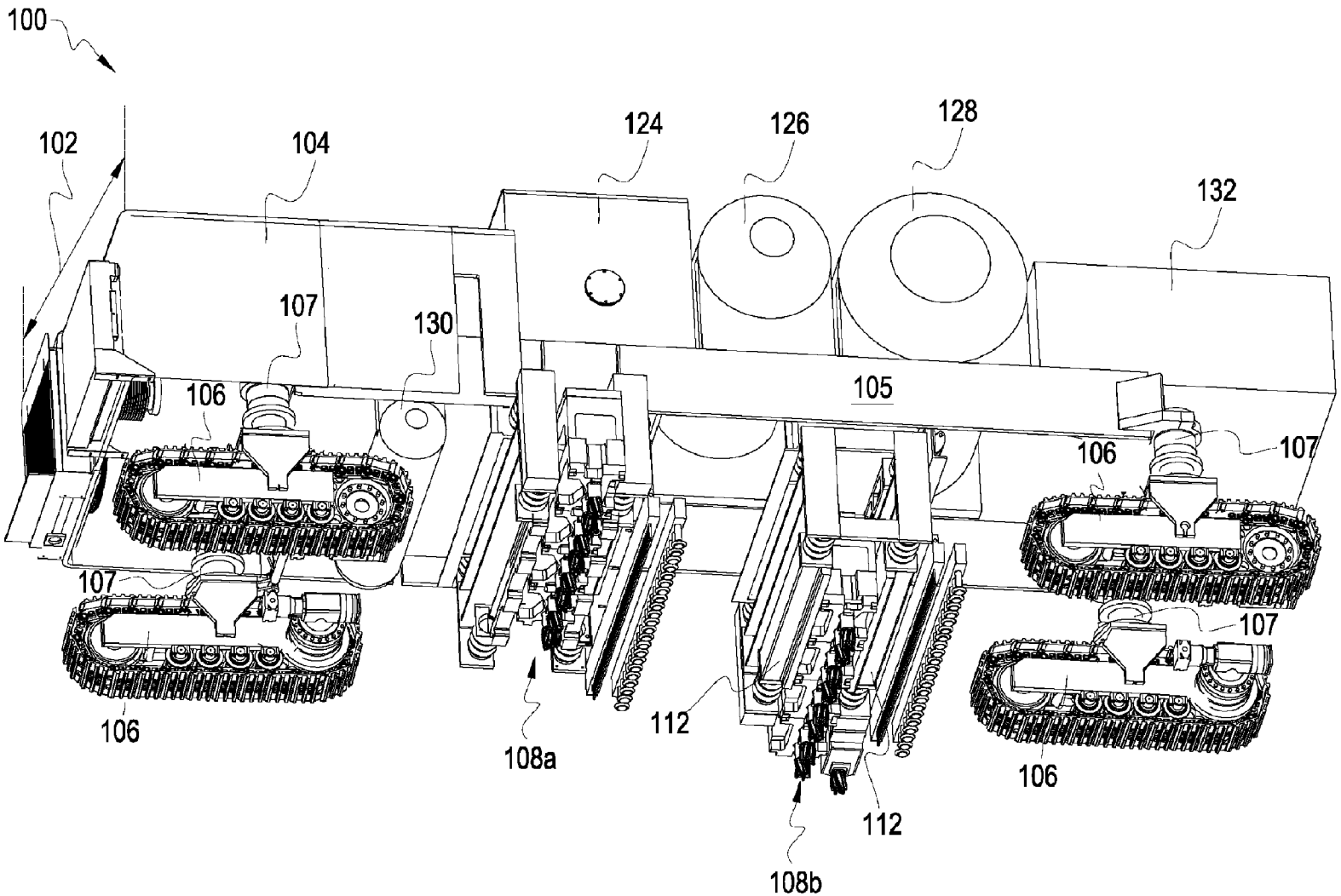
FIG. 1 is a perspective view illustrating one embodiment of a pavement recycling machine in accordance with the invention.
Figure 2:
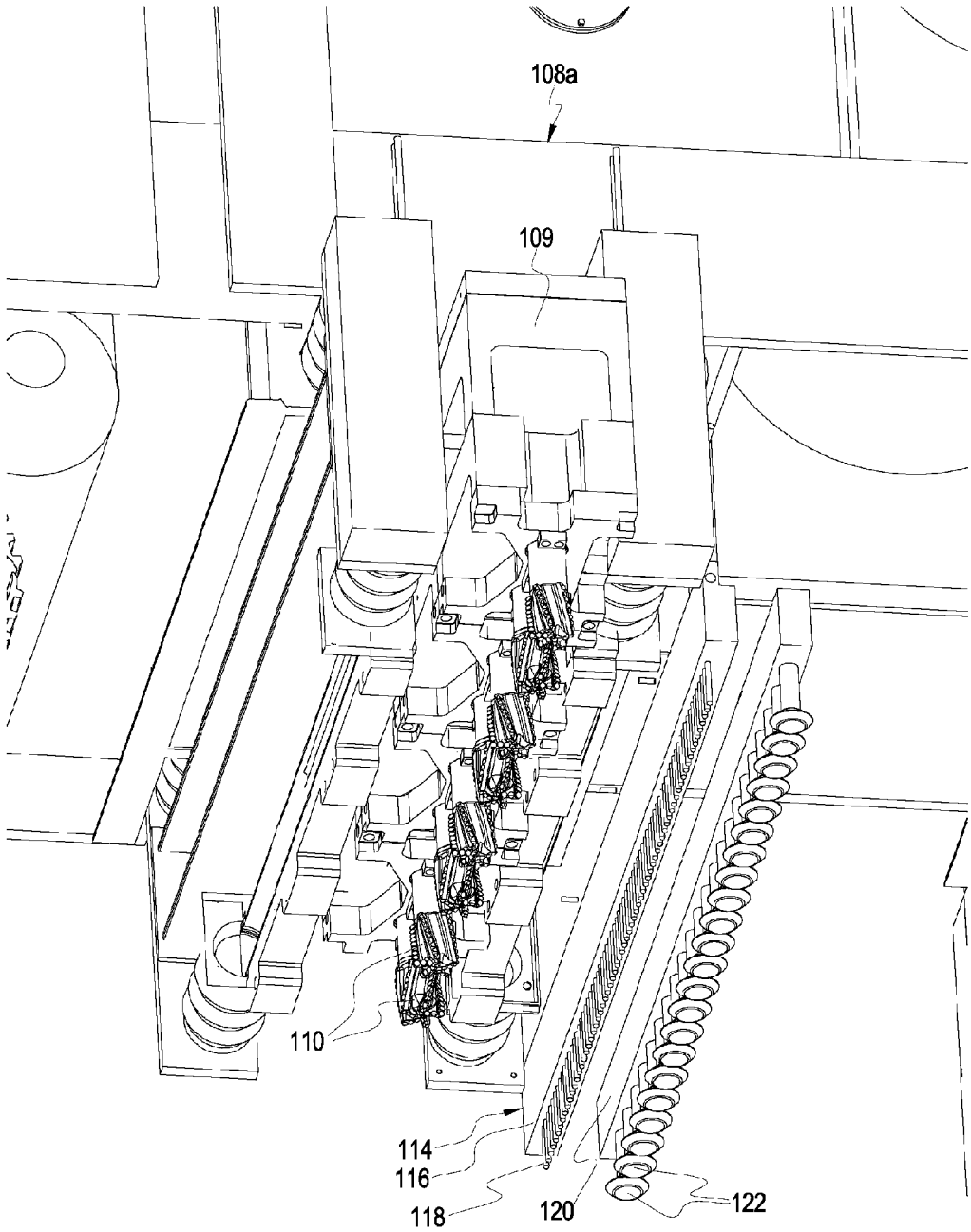
FIG. 2 is a perspective view of one embodiment of a support assembly comprising a bank of pavement degradation tools.

Referring to FIGS. 1 and 2, in selected embodiments, a pavement recycling machine 100 may be adapted to degrade and recycle a section of pavement substantially wider than the machine's width 102. The pavement recycling machine 100 may include a shroud 104, covering various internal components of the pavement recycling machine 100, a frame 105, and a translation mechanism 106 such as tracks, wheels, or the like, to translate or move the machine 100, such translation mechanisms being well known to those skilled in the art. The pavement recycling machine 100 may also include means 107 for adjusting the elevation and slope of the frame 105 relative to the translation mechanism 106 to adjust for varying elevations, slopes, and contours of the underlying road surface.

In selected embodiments, to facilitate degradation of a swath of pavement wider than the pavement recycling machine 100, the recycling machine 100 may include two or more support assemblies 108*a*, 108*b* that are capable of extending beyond the outer edge of the pavement recycling machine 100. Because the support assemblies 108*a*, 108*b* may be as wide as the vehicle itself, the extended support assemblies 108*a*, 108*b* may sweep over a width approximately twice the vehicle width 102. These assemblies 108*a*, 108*b* may include banks 109 of pavement degradation tools 110 that rotate about an axis substantially normal to a plane defined by a paved surface. Each of these pavement degradation tools 110 may be used to degrade a paved surface in a direction substantially normal to their axes of rotation.

To extend the support assemblies 108*a*, 108*b* beyond the outer edge of the pavement recycling machine 100, each of the support assemblies 108*a*, 108*b* may include actuators 112, such as hydraulic cylinders, pneumatic cylinders, or other mechanical devices known to those of skill in the art, to move the assemblies 108*a*, 108*b* to each side of the machine 100. Each support assembly 108*a*, 108*b* may also include a rake 114 to level, smooth, and mix pavement aggregates, including new aggregates and reclaimed aggregates generated by the pavement degradation tools 110. As illustrated, a rake 114 may include a housing 116 comprising multiple teeth 118 extending therefrom. In selected embodiments, each of the teeth 118 may be independently extended and retracted relative to the housing 116. This feature may allow selected teeth to be retracted to avoid obstacles such as manholes, grates, or other obstacles in the roadway.

In certain embodiments, each of the teeth 118 may be hollow to accommodate a flow of pavement rejuvenation materials for deposit on a road surface. Pavement rejuvenation materials may include, for example, asphalt, bitumen, tar, oil, water, combinations thereof, or other suitable materials, resins, and binding agents. These rejuvenation materials may be mixed with various aggregates, including new aggregates and reclaimed aggregates generated by the pavement degradation tools 110. The resulting mixture may then be smoothed and compacted to form a recycled road surface. In selected embodiments, the rake 114 may move side-to-side, front-to-back, in a circular pattern, vibrate, or the like to aid in mixing the resulting mixture of aggregates and rejuvenation materials. In certain embodiments, each support assembly 108*a*, 108*b* may include a bank 120 of one or more tampers 122 to compact the recycled road surface. Like the teeth 118, the tampers 122 may, in certain embodiments, be independently extendable and retractable relative to the bank 120.

Under the shroud 104, the pavement recycling machine 100 may include an engine and hydraulic pumps for powering the translation mechanism 106, the support assemblies 108*a*, 108*b*, the pavement degradation tools 110, or other components. Likewise, the pavement recycling machine 100 may include a tank 124 for storing hydraulic fluid, a fuel tank 126, a tank 128 for storing rejuvenation materials such as asphalt, bitumen, oil, tar, or the like, a water tank 130, and a hopper 132 for storing aggregate such as gravel, rock, sand, pebbles, macadam, concrete, or the like.

Figure 3:
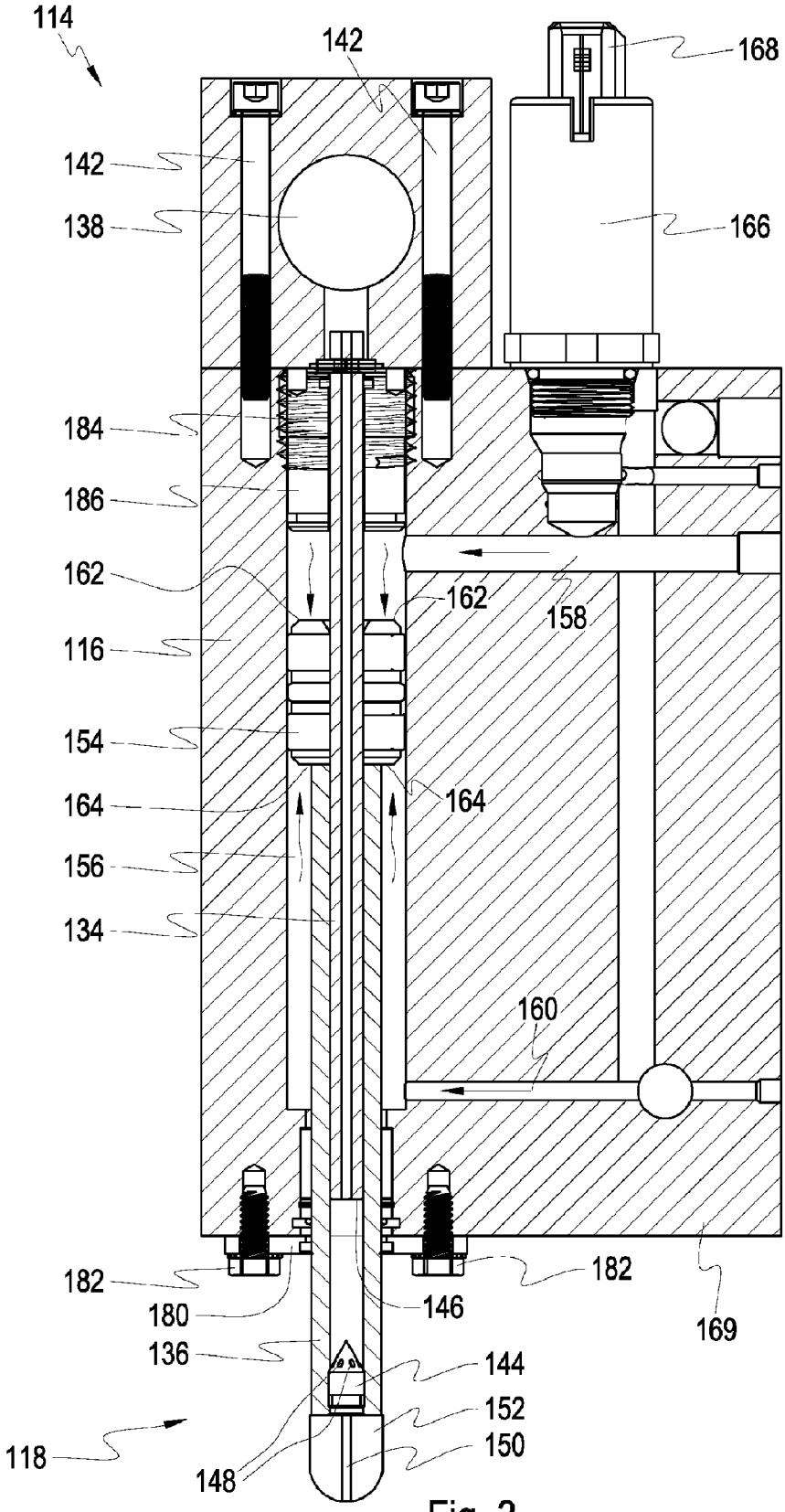
FIG. 3 is a cross-sectional view of a rake for depositing pavement rejuvenation materials on a road surface, the rake being in an extended position.

Referring to FIG. 3, as previously mentioned, a rake 114 may comprise a housing 116 and multiple teeth 118 extending therefrom. A duct 138 may travel through the housing 116 to provide a supply of rejuvenation materials under pressure to each of the teeth 118. In certain embodiments, the duct 138 may travel through a separate housing 140 which may be bolted or otherwise connected to the main housing 116 using connectors 142, such as bolts 142.

In certain embodiments, a tooth 118 may comprise a first channel 134 in communication with the supply of pavement rejuvenation materials provided by the duct 138. The outside diameter of the first channel may slide inside a second channel 136 thereby transmitting the supply of pavement rejuvenation materials into the second channel 136. In certain embodiments, the first channel 134 may remain relatively fixed with respect to the housing 116, while the second channel 136 may extend and retract (downward in the illustrated embodiment) with respect to the first channel 134 and the housing 116. A seal may be provided between the first channel 134 and the second channel 136 to prevent leakage of rejuvenation materials where the two channels 134, 136 interface.

A blocking element 144 may be coupled to the second channel 136. In the illustrated embodiment, the blocking element 144 has a conical shape although other shapes are possible and within the scope of the invention. As will become apparent in the description associated with FIG. 4, as the second channel 136 slides upward with respect to the first channel 134, the blocking element 144 contacts a seat 146 coupled to the first channel 134. The blocking element 144 and the seat 146 together form a valve 144, 146. Upon contacting the seat 146, the blocking element 144 seals off the first channel 134, thereby cutting off the flow of rejuvenation materials. Thus, when the tooth 118 is retracted (i.e., slid upward), the flow of pavement rejuvenation materials is cut off. Conversely, when the tooth 118 is extended, the valve 144, 146 opens and re-initiates the flow of rejuvenation materials. As shown, the blocking element 144 may include one or more passageways 148 to accommodate a flow of pavement rejuvenation materials when the valve 144, 146 is open. These passageways 148 may connect to a path 150 for depositing the pavement rejuvenation materials on a road surface.

The hardened tip 152 may be coupled to the second channel 136 to provide added durability to the tooth 118 and to resist the abrasive effects of pavement materials (i.e., rock, gravel, concrete, etc.) on the road surface. For example, in certain embodiments, the hardened tip 152 may be coated with diamond, boron nitride, a cemented metal carbide, or combinations mixtures, or alloys thereof, to provide added durability. A hardened tip may also reduce wear and/or corrosion.

In some embodiments of the present invention, a nozzle may be fitted within the path 150 for depositing the pavement rejuvenation materials on a road surface. The nozzle may increase the pressure exerted on the pavement rejuvenation materials as they exit the path 150. A nozzle may also increase the temperature of the pavement rejuvenation material immediately before the rejuvenation material exits the path 150, which may allow rejuvenation material to be heated to a higher temperature before they are deposited. The nozzle may also comprise a particular pattern which may help deposit the rejuvenation material in a specific desired manner. Individual teeth 118 may comprise a nozzle with a different pattern such that the teeth near the end of the swath of pavement may deposit the rejuvenation material differently than the teeth that are positioned near the middle of the same swath of pavement.

To extend and retract the tooth 118, a piston 154 may be coupled to the second channel 136 and slide with respect to the first channel 134. The first channel 134 may slide through a bore in the piston 154. The housing 116 may comprise a chamber 156 to accommodate the travel of the piston 154. In certain embodiments, the piston 154 may be driven by hydraulic fluid supplied under pressure to the chamber 156, although it is contemplated that pressurized air or other fluids could also be used. In one embodiment, hydraulic fluid may be supplied to the chamber 156 through a pair of passageways 158, 160 in the housing 116. Hydraulic fluid supplied under pressure through a first passageway 158 may exert force on a first surface 162 of the piston 154, while hydraulic fluid supplied under pressure through a second passageway 160 may exert force on a second surface 164 of the piston 154. Because the second channel 136 may connect to one end of the piston 154, the area of the first surface 162 may be larger than the area of the second surface 164. Thus, applying equal hydraulic pressure to each of the first and second surfaces 162, 164, the piston 154 will be urged downward due to the greater area of the surface 162.

In order to extend and retract the tooth 118, in selected embodiments, hydraulic pressure may be supplied continuously over time through the passageway 160. Conversely, a roughly equal hydraulic pressure may be selectively turned on or off through the passageway 158 by way of a valve 166. Thus, when hydraulic pressure through the passageway 158 is turned off, continuous pressure supplied through the passageway 160 urges the piston 154 upward. As the piston 154 travels upward, hydraulic fluid above the piston 154 and inside the passageway 158 may flow into a hydraulic fluid reservoir or tank (not shown). On the other hand, when hydraulic pressure through the passageway 158 is turned on, this hydraulic pressure overcomes the hydraulic pressure supplied through the passageway 160 (due to the difference in the piston surface areas 162, 164), thereby urging the piston 154 downward and extending the tooth 118 relative to the housing 116. Although the present invention is not limited by any set pressure or range of pressures, in selected embodiments, the piston 154 may be actuated by fifty to one hundred and fifty PSI of hydraulic pressure. In selected embodiments, the valve 166 may be solenoid driven, be screwed into the housing 116, and be actuated by way of an electrical connection 168.

At or near the bottom surface 169 of the housing 116, one or more bushings may be used to act as a bearing between the second channel 136 and the housing 116, and one or more seals may be used to contain the hydraulic pressure within the chamber 156 and to prevent contamination from entering the chamber 156. The bushings and/or seals may be retained and accessed by way of a plate 180 coupled to the housing 116 by way of one or more connectors 182, such as bolts 182. Similarly, a retainer 184 may be positioned at or near the top of the chamber 156 and may be used to retain the first channel 134 in a substantially fixed position with respect to the housing 116. In selected embodiments, the retainer 184 may be screwed into the housing 116 and may include a clip to engage a slot milled in the first channel 134. The retainer 184 may also include a stopper 186 to stop the upward travel of the piston 154. In certain embodiments, the retainer 184 may be accessed by removing the duct housing 140 from the main housing 116.

Figure 4:
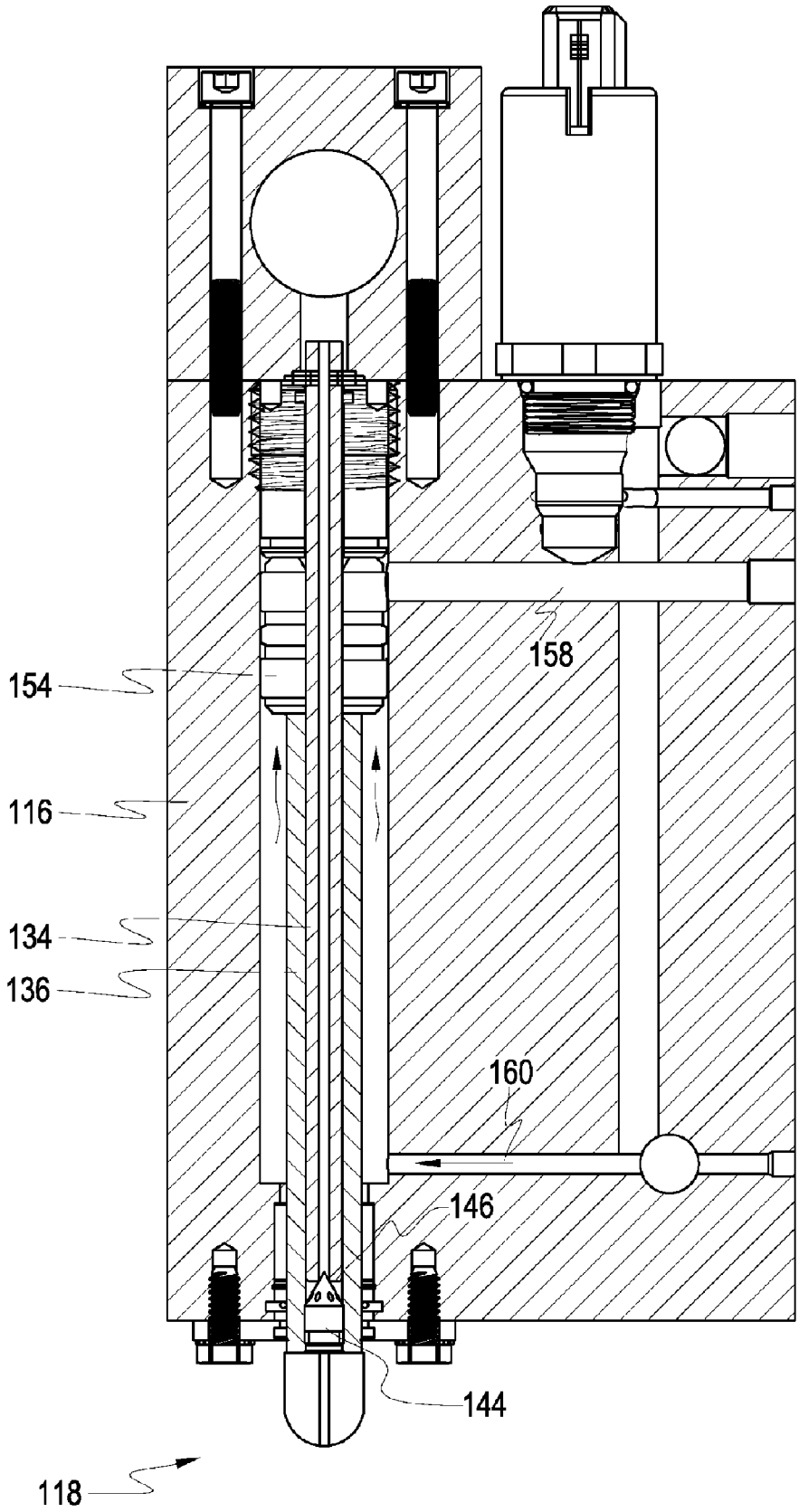
FIG. 4 is a cross-sectional view of the rake of FIG. 3 in a retracted position.

Referring to FIG. 4, upon turning off the hydraulic pressure in the passageway 158, hydraulic pressure through the passageway 160 urges the piston 154 and the second channel 136 upward, thereby retracting the tooth 118 relative to the housing 116. As the tooth 118 moves upward, the blocking element 144 (in this embodiment a conically shaped blocking element) contacts the seat 146, thereby blocking the first channel 134. This cuts off the flow of pavement rejuvenation materials flowing through the first and second channels 134, 136.

Figure 5:
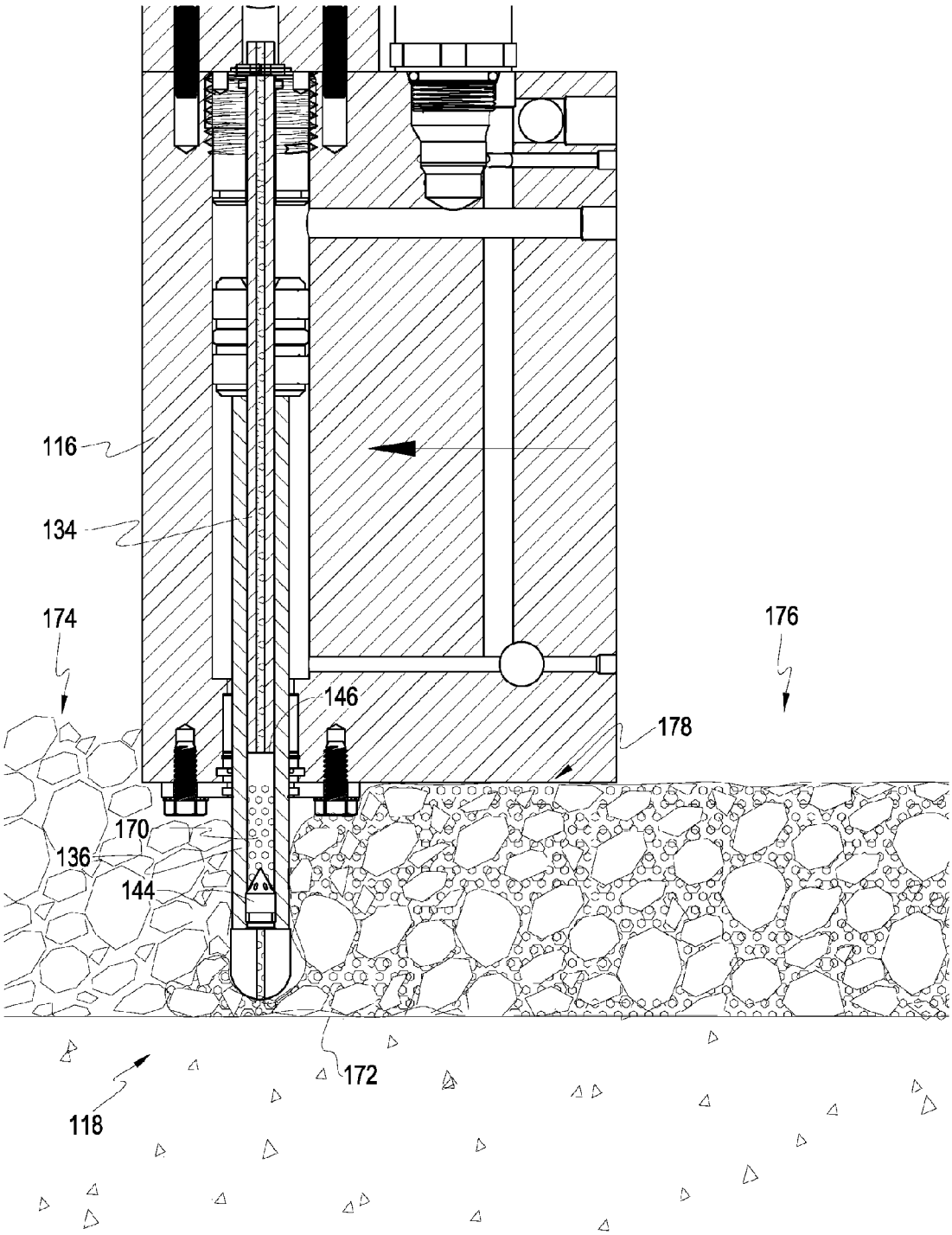
FIG. 5 is a cross-sectional view of a rake depositing pavement rejuvenation materials into various aggregates residing on a road surface.

Referring to FIG. 5, as previously mentioned, a valve 144, 146 opens upon extending a tooth 118 relative to the housing 116. This allows rejuvenation materials 170 to flow through the first and second channels 134, 136 onto a road surface 172. As previously explained with respect to FIG. 3, rejuvenation materials 170 may be supplied under pressure by way of a duct 138 communicating with the first and second channels 134, 136. Once expelled from the tooth 118, the rejuvenation materials 170 may be mixed with aggregates 174, which may include reclaimed pavement aggregates generated by the pavement degradation tools 110 (referring back to FIGS. 1 and 2), new aggregates, or combinations thereof. The resulting mixture 176 may then be smoothed and compacted to form a new or recycled pavement surface. In certain embodiments, a bottom surface 178 of the housing 116 may be used as a screed to smooth and/or compact the resulting pavement mixture 176.

In selected embodiments, the rejuvenation materials 170 may be discharged from the tooth 118 in a "foamed" state. For example, in certain embodiments, a mixture of water and hot bitumen may be discharged from the tooth 118. The pressure drop that occurs upon discharge may cause the mixture of hot bitumen and water to spontaneously transform into foam. This "foamed bitumen" significantly reduces the viscosity of the bitumen, which allows bitumen to be more easily mixed with the aggregates 174. The foamed bitumen may also expand to saturate and permeate the aggregates 174. The resulting mixture, or "foamed asphalt," may provide several significant advantages when performing in place, or in situ, pavement recycling. For example, it is reported that foamed bitumen increases the shear strength of the resulting paved surface, while reducing its susceptibility to moisture. The strength of foamed asphalt may approach that of cemented materials, while being more flexible and fatigue resistant than cemented materials.

Furthermore, when performing cold mix processes, it is reported that this foaming technique allows bitumen (or other rejuvenation materials) to be mixed with a wider variety of aggregates. Foamed asphalt may also require less binder and water than other methods of cold mixing, which reduces binder and transportation costs. Foamed asphalt can also be compacted and used immediately upon deposit to the road surface, thereby saving time and money. Furthermore, this technique conserves energy because only the bitumen requires heating; the aggregates may be mixed while cold or damp.

Other advantages include reported environmental benefits. The foaming technique reduces environmental harm that may occur from the evaporation of volatiles from the asphalt mix because curing generally does not release volatiles into the environment. According to some reports, foamed asphalt may also be stockpiled without binder runoff or leeching. The foamed asphalt also remains workable for extended periods of time, providing additional time for compaction, shaping, finishing, and the like. Reportedly, foamed asphalt may be deposited even in adverse weather conditions, such as cold temperatures or light rain, without changing the characteristics or quality of the material.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An apparatus for regulating a flow of pavement constituents for deposit on a roadway, the apparatus comprising:

a first channel supported by a pavement recycling machine and in communication with a supply of pavement rejuvenation materials;

a second channel slideably coupled to the first channel, the pavement rejuvenation materials adapted to flow through the first channel and into the second channel;

a hardened tip rigidly coupled to a distal end of the second channel; and a vibration mechanism operably coupled to the first and second channels;

wherein the hardened tip moves with the second channel and vibration from the vibration mechanism is adapted to mix the pavement constituents on the roadway.

2. The apparatus of claim 1, wherein the apparatus further comprises a seat coupled to one of the first and second channels; and a blocking element coupled to the other of the first and second channels, the blocking element adapted to contact the seat upon sliding the second channel with respect to the first channel, thereby impeding the flow of pavement rejuvenation materials flowing through the first and second channels.

3. The apparatus of claim 1, further comprising sealing means for sealing the first channel with respect to the second channel.

4. The apparatus of claim 1, further comprising an actuator to slide the second channel with respect to the first channel.

5. The apparatus of claim 4, wherein the actuator is selected from the group consisting of a hydraulic, solenoid, mechanical, and pneumatic actuator.

6. The apparatus of claim 4, wherein the actuator is adapted to extend and retract the second channel with respect to a roadway.

7. The apparatus of claim 1, wherein the second channel slides over the first channel.

8. The apparatus of claim 7, further comprising a hydraulic piston rigidly coupled to the second channel.

9. The apparatus of claim 8, further comprising a housing containing a chamber, the chamber accommodating and facilitating linear travel of the hydraulic piston.

10. The apparatus of claim 1, further comprising a vibration mechanism operably coupled to the first and second channels.

* * * * *